United States Patent [19]

Malacheski

[11] 4,135,074

[45] Jan. 16, 1979

[54] AUTOMATIC KEYBOARD OPERATOR

[75] Inventor: Joseph J. Malacheski, Wilkes-Barre, Pa.

[73] Assignee: Donald Gutkowski, Ashley, Pa. ; a part interest

[21] Appl. No.: 819,065

[22] Filed: Jul. 26, 1977

[51] Int. Cl.[2] ..... H01H 3/20

[52] U.S. Cl. ..... 200/330; 200/46; 200/332; 179/90 CS; 179/90 K

[58] Field of Search ..... 200/46, 330, 332; 235/145 R, 146; 179/90 AD, 90 CS, 90 K; 178/17 C; 340/365 R

[56] References Cited

U.S. PATENT DOCUMENTS

| | | | |
|---|---|---|---|
| 957,221 | 5/1910 | Lamkin | 235/146 |
| 3,194,893 | 7/1965 | Auel | 179/90 CS |
| 3,634,631 | 1/1972 | Youngs | 179/90 CS |
| 3,821,487 | 6/1974 | Haynes | 179/90 AD |
| 4,034,163 | 7/1977 | Youngs | 179/90 CS |

*Primary Examiner*—Herbert F. Ross

*Attorney, Agent, or Firm*—Robert K. Youtie

[57] ABSTRACT

An automatic keyboard operator including a plurality of carriers located over the keys of a keyboard, each carrier having a depending depressor for engaging a respective key and an upstanding tab for engagement by an actuator, the actuator being prearranged to engage preselected tabs for depressing corresponding keys.

8 Claims, 14 Drawing Figures

FIG. 2
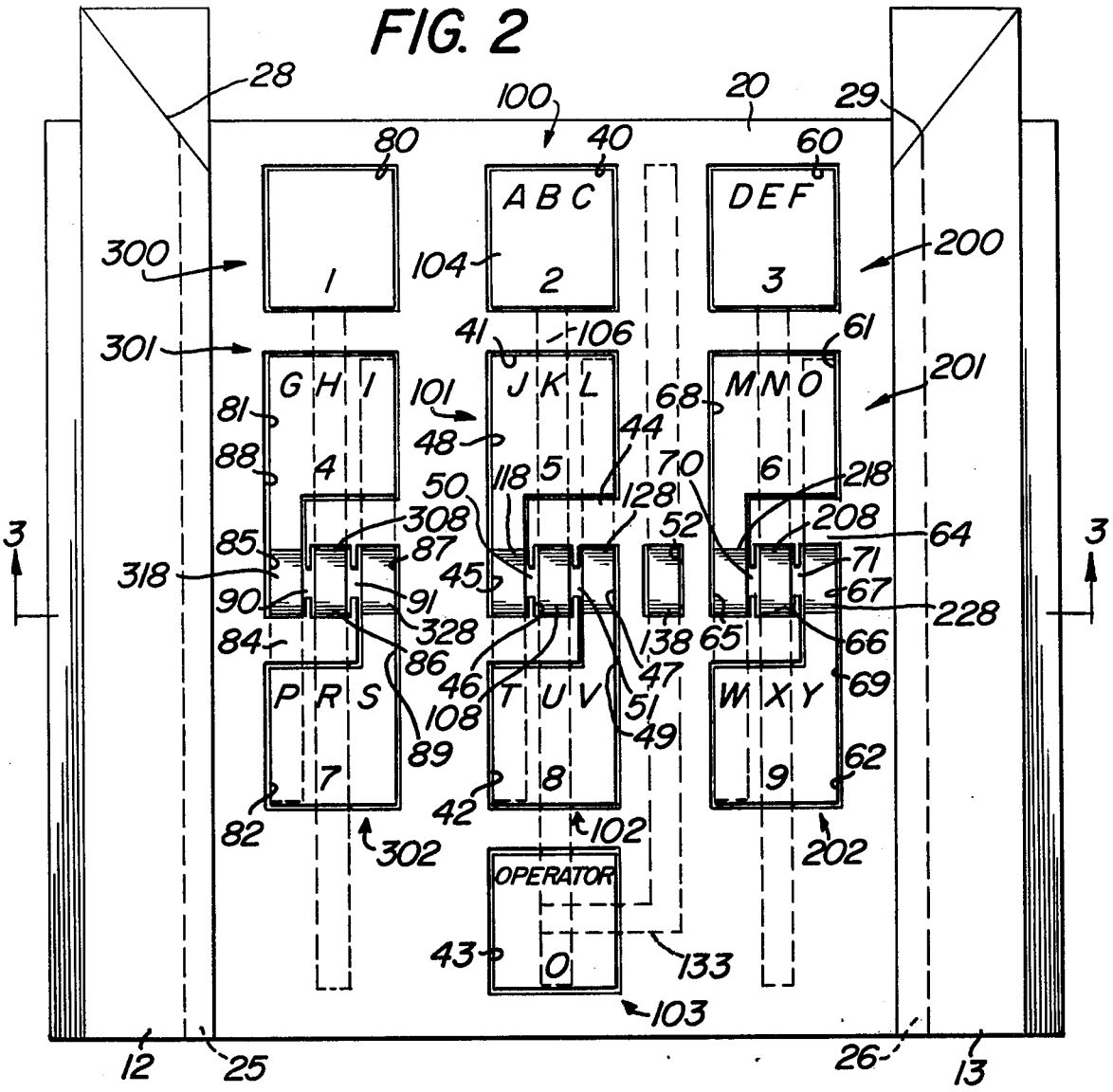
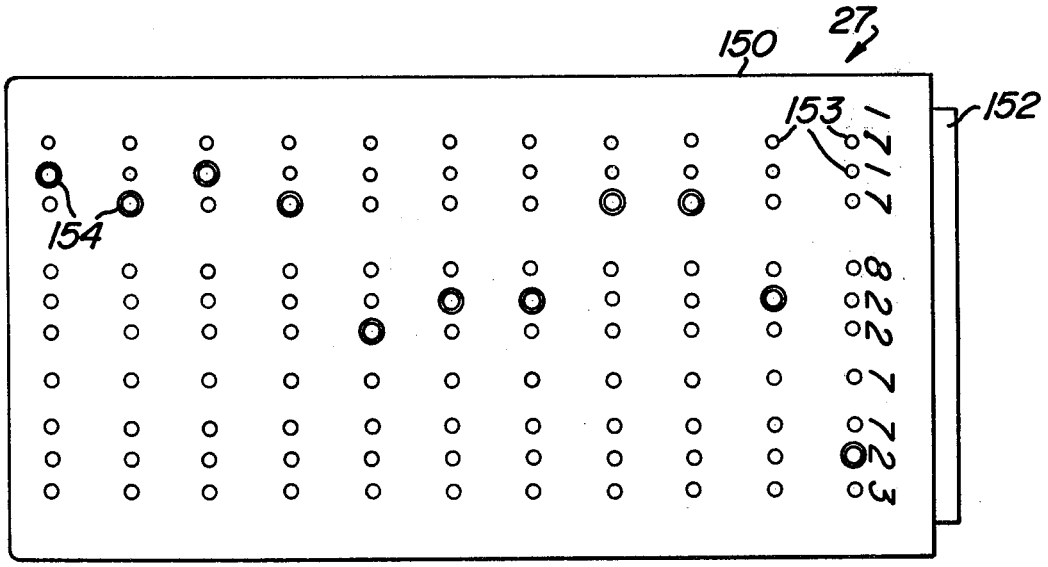
FIG. 12

FIG. 3
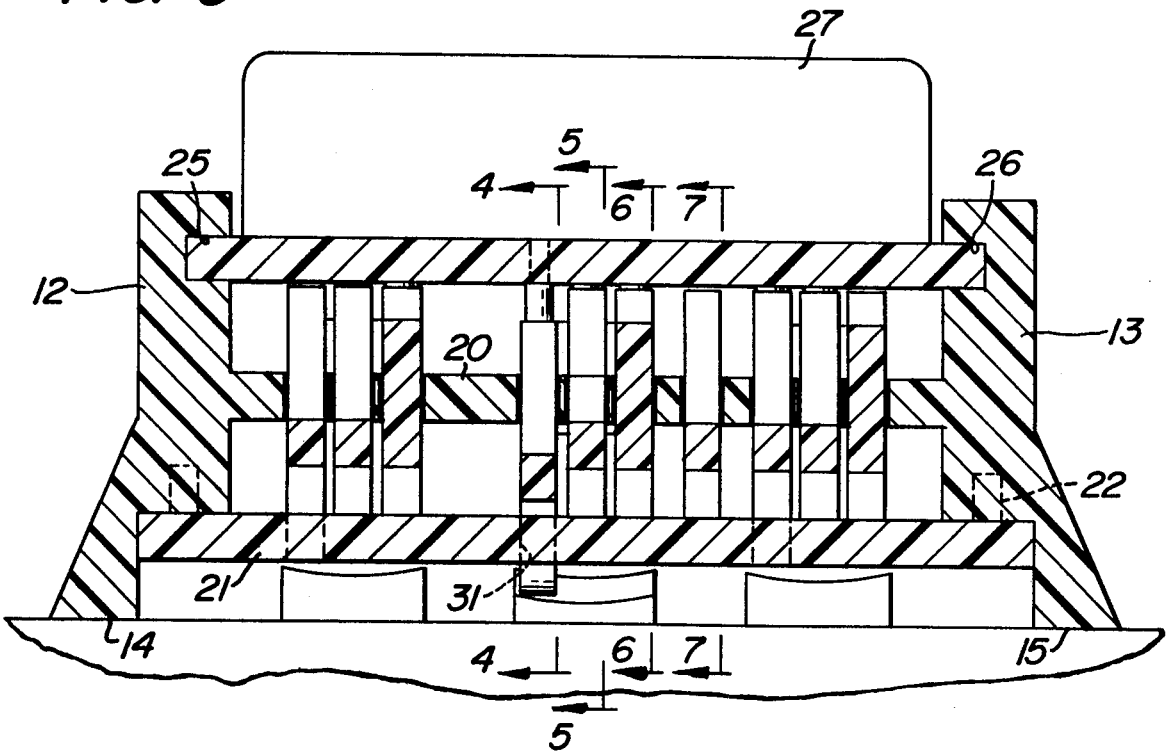
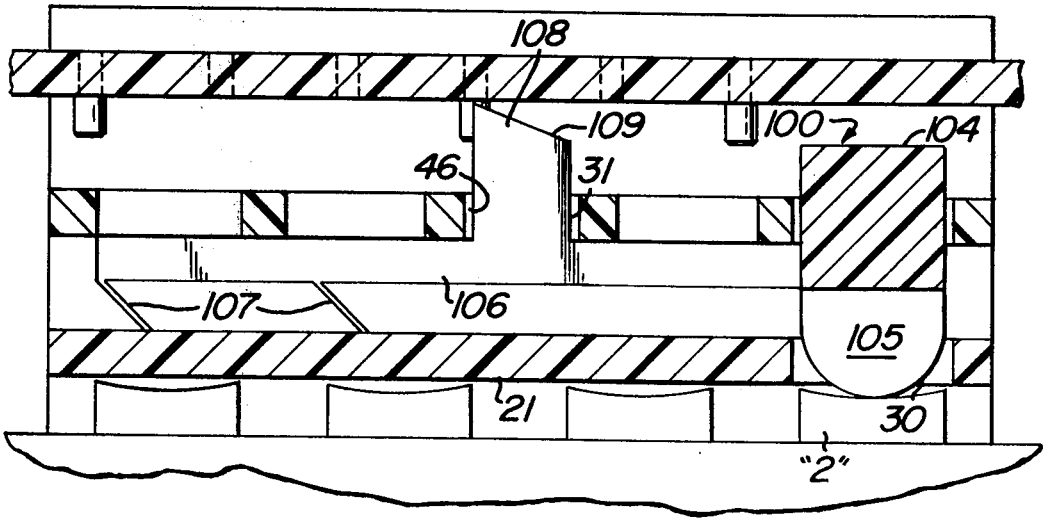
FIG. 5

FIG. 6
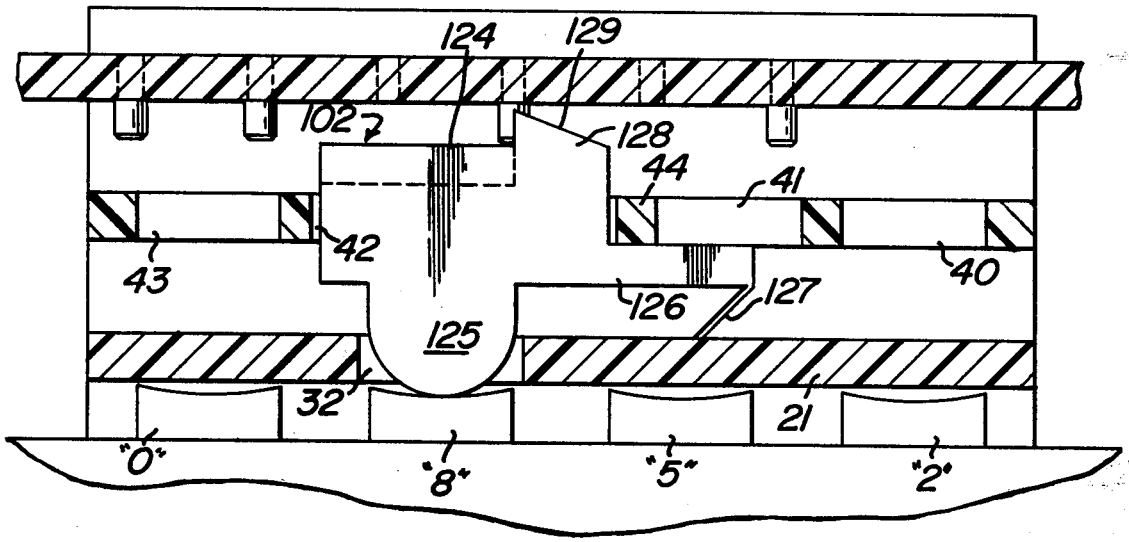
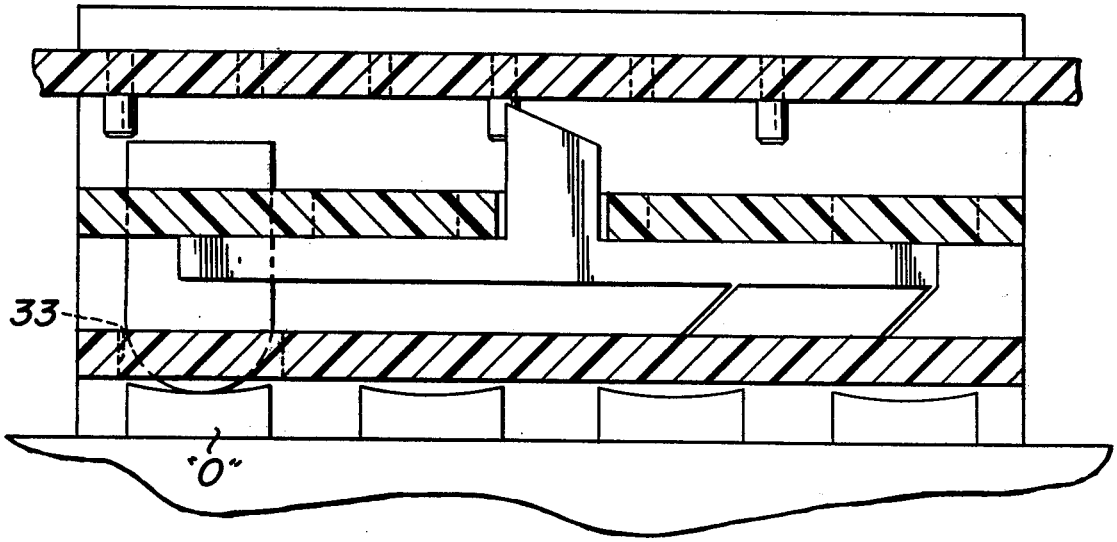
FIG. 7

AUTOMATIC KEYBOARD OPERATOR

BACKGROUND OF THE INVENTION

While there have, in the past, been proposed automating devices for operating keyboards, such devices have not found general acceptance as being relatively complex in construction, expensive to manufacture and maintain, inconvenient to convert between manual and automatic operation, and lacking in durability and reliability throughout a long useful life.

SUMMARY OF THE INVENTION

Accordingly, it is an important object of the present invention to provide an automatic operator for a keyboard which overcomes the above-mentioned difficulties, is extremely simple in structure for economy in manufacture, assembly and installation, which requires no conversion for alternating between manual and automatic operation, and which by its simplicity of construction is of extremely high durability and reliability throughout a long useful life.

While the automatic keyboard operator of the present invention has been primarily developed and employed for use in association with telephone keyboards, such as the well-known "Touch-Tone" telephones now gaining favor, and is described and illustrated herein with particular reference thereto, it is appreciated that the instant device is capable of use and association with a wide variety of keyboards in many different applications, all of which are intended to be comprehended herein.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described and of which the scope will be indicated by the appended claims.

BRIEF DESCRIPTION OF THE DRAWINGS

FIG. 2 is a top plan view showing the operator of FIG. 1.

FIG. 3 is a sectional elevational view taken generally along the line 3—3 of FIG. 2.

FIG. 5 is a sectional elevational view taken generally along the line 5—5 of FIG. 3.

FIG. 6 is a sectional elevational view taken generally along the line 6—6 of FIG. 3.

FIG. 7 is a sectional elevational view taken generally along the line 7—7 of FIG. 3.

FIG. 12 is a plan view showing an actuator for the instant operator.

DESCRIPTION OF THE PREFERRED EMBODIMENTS

Figure 1:
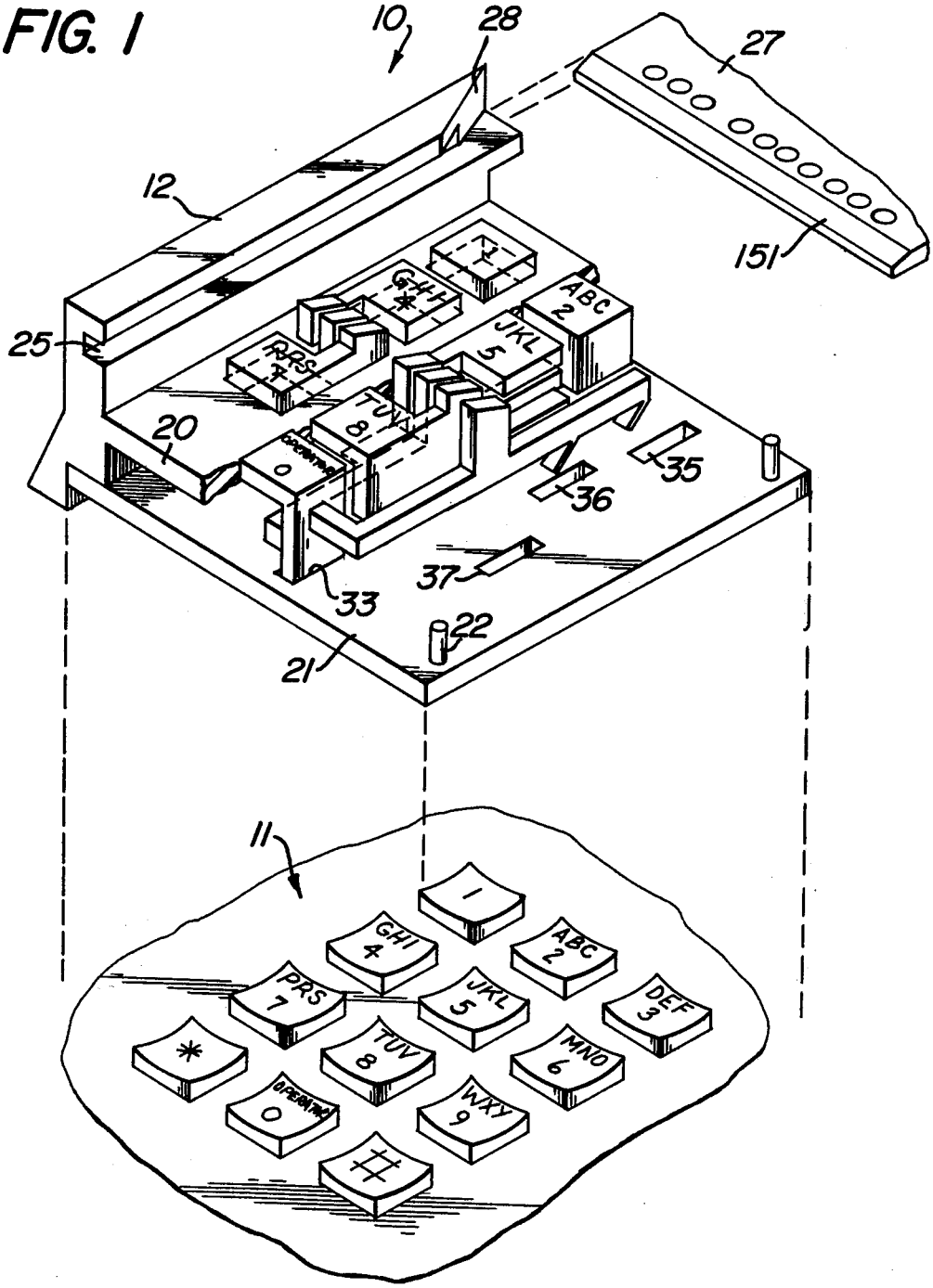
FIG. 1 is a top perspective view showing a keyboard operator of the present invention exploded with respect to a telephone keyboard, the operator being partly broken away and partly in section for clarity of illustration.

Referring now more particularly to the drawings, and specifically to FIG. 1 thereof, the automatic operator of the present invention is there generally designated 10, and illustrated in association with a telephone keyboard 11. In conventional manner, the keyboard 11 includes a checkered or grid-like array of keys, including a plurality of generally laterally disposed ranks and longitudinally disposed files of keys. More specifically, the keys "1," "2," and "3" may constitute the upper most rank of keys, while the row of keys "1," "4," and "7" may constitute the left most file of keys. Thus, the generally rectangular array of numbered keys may be considered as constituting a plurality of lateral ranks and longitudinal files of keys.

The operator 10 is superposed over the keyboard 11, and suitably secured thereto, as by adhesive or other suitable securing means. In particular, the operator 10 may include a pair of laterally spaced upstanding side walls or supports 12 and 13 on opposite sides of the keyboard and extending in general parallelism with each other and with the longitudinal files of keys.

The upstanding supports or side walls 12 and 13 may have their undersurfaces 14 and 15, respectively, seated on and suitably secured, as by adhesive, to the top of a telephone, on opposite sides of the keyboard.

Extending laterally between the upstanding side members or supports 12 and 13, spaced over and in a plane generally parallel to that of the keyboard 11, is an upper guide means or plate 20 having through openings, as will appear presently in greater detail.

Spaced below the upper guide member or plate 20, in general parallelism therewith, and directly over the keyboard 11 extending laterally between and secured to side supports 12 and 13, is a lower guide member or plate 21. In the illustrated embodiment, the upper guide member or plate 20 may be formed integrally with the side walls or supports 12 and 13, as by injection or extrusion molding, or otherwise, and the lower guide member or plate 21 may be pinned, as at 22, or otherwise suitably fixed in position extending between lower regions of the side members or supports.

Upper inner or facing regions of the side members or supports 12 and 13 may be formed with longitudinally extending, open-ended facing receivers or grooves 25 and 26, for slidably receiving opposite longitudinal or side edge margins of a platelike actuating member 27. The upper entry regions of receiver grooves 25 and 26 may be bevelled, as at 28 and 29 to facilitate entry of the actuating member 27 into the grooves 25 and 26.

The operator mechanism associated with the file of keys "1, 4 and 7" is essentially identical to the operator mechanism associated with the file of keys "3, 6 and 9," which is also substantially identical to the operator mechanism associated with the file of keys "2, 5 and 8." Hence, it will suffice to describe in detail only the operator mechanism associated with a single file of keys. The laterally medial file of keys includes an additional key "0," and therefore requires an additional carrier, as will become apparent.

Considering the laterally medial rank of keys "2, 5, 8 and 0" in detail, the lower guide member or plate is provided over the laterally medial file of keys with a plurality of through openings or guide holes arranged in longitudinally spaced relation with each guide hole over a respective key, and laterally spaced relation with respect to each other.

More specifically, the lower guide member or plate 21 is formed over the key "2" with a through guide opening or hole 30, see FIGS. 3 and 5, which guide hole is laterally medially of the key. Over key "5" the lower guide means or plate 21 is formed with a through guide hole or opening 31, see FIG. 4, which is spaced laterally leftward over the key "5." Over the key "8" the lower guide means or plate 21 is formed with a through guide hole or opening 32, being spaced laterally rightward or over a rightward region of the key "8." Over the additional key "0," over the laterally rightward region thereof, may be an additional through opening or guide hole 33, see FIGS. 1 and 7. The guide opening 33 may be generally aligned with the guide opening 32 longitudinally of the laterally medial file of keys.

Thus, the several guide openings 30, 31, 32 and 33 may all be arranged over the single laterally medially aligned row of keys "2, 5, 8 and 0" and are laterally offset from each other.

Similarly, over the laterally rightward file of keys "3, 6 and 9" there are provided in the lower guide means 21 a series of through guide openings or holes 35, 36 and 37, respectively, the series of guide hole 35–37 are arranged in longitudinally spaced relation over the respective keys of rightward file of keys "3, 6 and 9" and are laterally spaced or offset with respect to each other. The upper most guide hole 35 may be laterally medially of its nether key "3," while the intermediate guide hole 36 may be located over the laterally leftward region of its nether key "6," and the lower guide hole 37 may be located over the rightward lateral region of its nether key "9."

The laterally leftward file of keys "1, 4 and 7" are provided thereover in the lower guide plate 21 with respective through holes or guide openings similar to guide openings 30, 31 and 32 of the medial key file and guide openings 35, 36 and 37 of the rightward key file.

The upper guide means or plate 20 is provided over respective keys of keyboard 11 with corresponding through openings for receiving respective manually actuable carrier key portions. For example, as may be seen in FIG. 6, the upper horizontal guide means or plate 20 may be formed over respective keys "2, 5, 8 and 0" with through openings 40, 41, 42 and 43 for receiving respective manually actuable carrier key portions. As best seen in FIG. 6, it may be observed that the longitudinally intermediate guide openings or hole 41 and 42 are not directly over their respective keys "5 and 8," but respectively spaced more closely to their adjacent upper guide member holes 40 and 43 to leave a substantial intermediate region 44 of upper guide member 20 between holes 41 and 42. The intermediate region 44 of upper guide member 20 is formed with a lateral row of through guide openings or slots 45, 46 and 47, being respectively located laterally leftward, laterally medially and laterally rightward. The slot or guide opening 45 may extend upward, as at 48 for communication between the slot 45 and opening 41, while the rightward slot 47 may extend downward, as at 49 for communication between the rightward slot and the lower opening 42. The slots 45, 46 and 47 may open into each other, as through reduced portions or constrictions 50 and 51. The constriction 50 may open between adjacent slots 45 and 46, and the constriction 51 may open between adjacent slots 47 and 48.

Located over the rightward file of keys "3, 6 and 9," in the upper guide member 20 are a series of through guide holes or openings 60, 61 and 62, respectively laterally aligned with openings 40, 41 and 42. Thus, the guide holes or openings 61 and 62 are further spaced apart than the guide holes or openings 60 and 61, so that a top guide member region 64 intermediate the guide hole 61 and 62 is provided for formation therein of a lateral array or series of through slots 65, 66 and 67. The slots 65, 66 and 67 may be essentially similar to the respective slots 45, 46 and 47, the laterally leftward slot 65 being formed with an upward extension or opening 68 communicating with the next upper opening 61, and the laterally rightward slot 67 being provided a downwardly extending slot or opening 69 communicating with the next lower guide hole or opening 62. A reduced opening or constriction 70 may be provided communicating between adjacent slots 55 and 56, while a similar reduced opening or constriction 71 may communicate between adjacent slots 66 and 67.

Located over the laterally leftward row or series of keys "1, 4 and 7," in the upper guide member or plate 20 there are formed a longitudinal array of through guide holes or openings 80, 81 and 82 respectively laterally aligned with the guide holes or openings 40, 41 and 42. The guide holes or openings 81 and 82 are spaced apart to leave therebetween a substantial region 84 of guide member 20, which is provided with a lateral row or series of through slots 85, 86 and 87, corresponding generally to the lateral row of intermediate slots 45, 46 and 47. The leftward and rightward slots 85 and 87 may be respectively connected to the next adjacent upper and lower openings 81 and 82 by respective slot extensions or openings 88 and 89, while the adjacent slots 85 and 86 may be connected together by an intermediate opening or constriction 90, and the adjacent slots 86 and 87 may be connected together by an intermediate opening or constriction 91.

In addition to the above, the upper guide member or plate 20 may be formed with a slot 52 located adjacent to and rightward of the slot 47.

Associated with the upper most opening 40 of the laterally medial row of upper guide member openings is an upper carrier generally designated 100, while an intermediate carrier 101 is associated with the intermediate opening 42, and a lower carrier 102 is associated with the lower opening 42. An auxiliary carrier 103 is associated with the additional opening 43.

The upper carrier 100 includes an enlarged body portion or manual key portion 104 loosely or slidably received in guide member opening 40 and provided on its underside laterally, medially thereof with a convexly arcuate depending depressor 105 extending into guide opening 30 of lower guide member 21. This is best seen in FIG. 5, and also shown in FIG. 9. The carrier 100 further includes a relatively narrow, elongate body portion 106 extending beneath and located laterally medially of the several upper guide member through openings 41, 42 and 43. The elongate body portion 106 may be provided on its lower end, remote from the manual key portion 104 and depressor 105 with resiliently yieldable depending support means or feet 107. Thus, the carrier 100 is provided at its lower end with resiliently yieldable support by means of flexible feet 107, and provided at its upper end with resiliently yieldable support by engagement of depressor 105 with resiliently yieldable key "2." Intermediate the ends of elongate body portion 106, the carrier 100 is provided with an upstanding operating member or tab 108, which projects loosely or slidably upwardly through the laterally medial slot 46 and is provided on its upper end with a cam surface facing generally obliquely upwardly, as at 109. Thus, depression of tab 108, as by engagement of cam surface 109, will shift the carrier body portion 106 downwardly toward lower guide member 21 to depress key "2."

Figures 4, 8, 9, 10, 11, 13, 14:
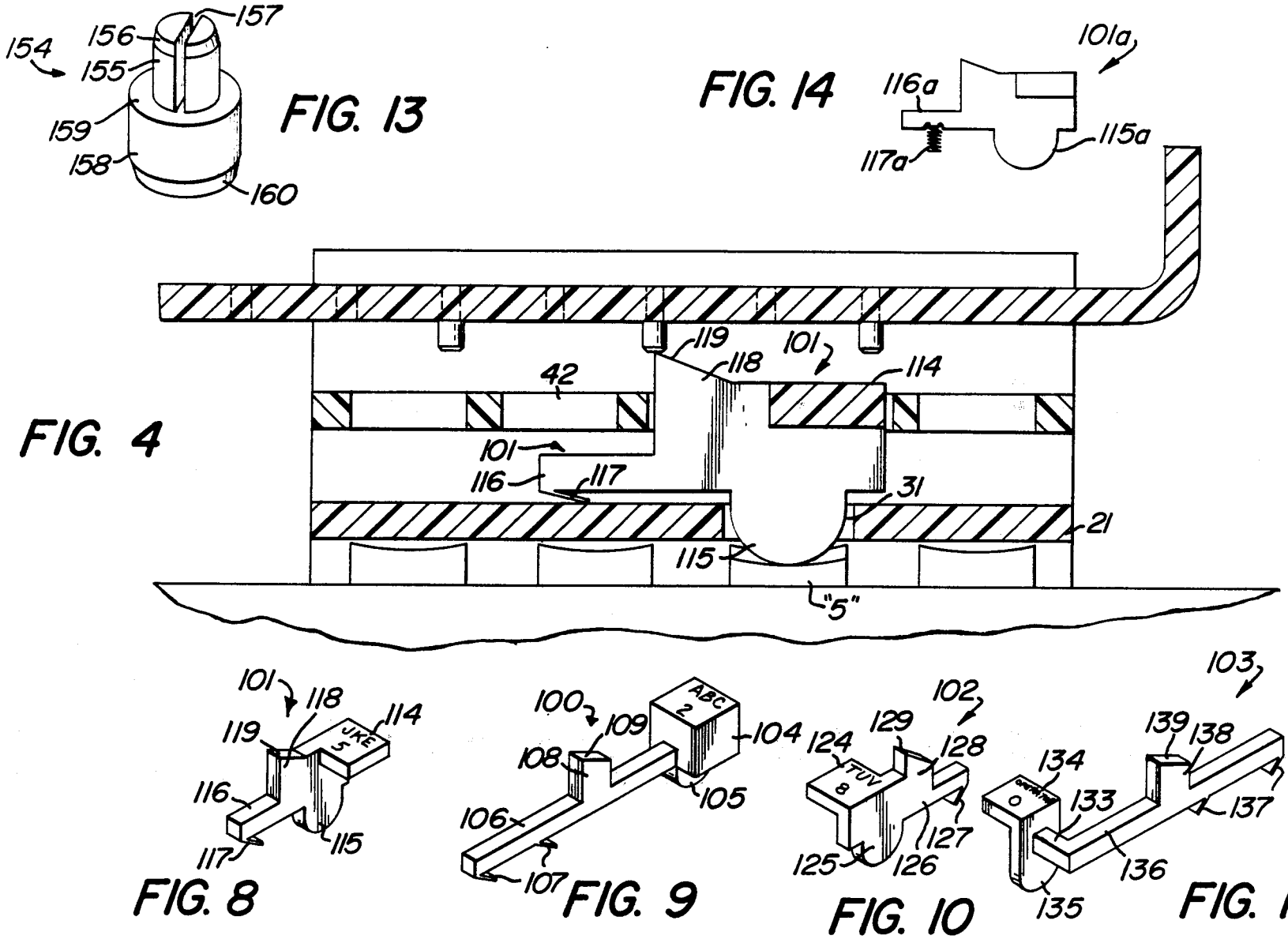
FIG. 4 is a sectional elevational view taken generally along the line 4—4 of FIG. 3.
FIGS. 8, 9, 10 and 11 are perspective views each showing a respective carrier of the instant operator, apart from the remainder thereof.
FIG. 13 is a perspective view showing a component of the actuator, apart therefrom.
FIG. 14 is a side elevational view showing a slightly modified form of carrier for use in the instant invention.

The carrier 101 may be best seen in FIGS. 4 and 8, and may include a laterally enlarged manual key portion 114 conformably and slidably received in upper guide member opening 41. Offset laterally leftward and extending from manual key portion 114 is an elongate carrier body portion 116 which extends beneath leftward slot 45 and the leftward portion of guide opening 42, as seen in FIG. 2. Depending beneath the key portion 114 and the elongate body portion 116, generally coplanar with the latter to be offset laterally leftward, is a depending, downwardly convex projection or depressor 115. As appears in FIG. 4, depressor 115 registers with and depends through lower guide opening 31 for depressing engagement with key "5." Remote from the depressor 115, depending beneath the body 116 is resilient bearing means or a leaf spring type foot 117 in supporting engagement with the lower guide plate 21. Thus, by the resilient support or leg 117 and engagement of the depressor 115 with key "5," the carrier 101 is resiliently yieldably supported against downward movement.

Upstanding from the body 116, generally coplanar therewith to be offset laterally leftward with respect to key portion 114, is a tab 118 having an inclined upper cam surface 119. The tab 118 upstands through the slot 45 and its connecting opening 48 for movement vertically therein upon depression of the carrier 101.

Associated with the lower guide opening 42 and its nether key "8" is the carrier 102, see FIGS. 6 and 10. The carrier 102 includes a key portion 124 conformably and spacedly received in upper guide opening 42 for up and down movement therein, and an elongate carrier body 126 extending from the underside of key portion 124 generally longitudinally of the file of keys beneath slot 47 and an adjacent portion of guide opening 41. The carrier body 126 is offset laterally rightward with respect to the key portion 124, directly beneath the slot 47 and extension 49. Depending from the underside of key portion 124, laterally offset rightward with respect thereto and substantially coplanar with the body 126, for entry into nether guide hole 32 is a convexly arcuate projection or depressor 125 for depressing engagement with the adjacent nether key "8." Remote from the depressor 125, depending from the carrier body 126 is a resilient support, leaf or leg 127 for yieldable supporting engagement with the upperside of lower guide plate 21. Thus, the carrier 102 is resiliently yieldably supported at opposite ends by flexible depending leg 127 and bearing engagement of depressor 125 with key "8."

Upstanding from the body 126, loosely or slidably through laterally rightward slot 47, is a tab 128 having an inclined or oblique upper cam surface 129.

The additional or auxiliary carrier 103 shown in FIGS. 7 and 11, includes a key portion 134 slidably received in auxiliary guide opening 43 and provided on one side, say the rightward side with a depending convexly arcuate projection or depressor 135, which enters downwardly through lower guide member opening 33 for depressing engagement with key "0." An elongate carrier body member 136 extends longitudinally of and is laterally offset from the laterally medial file of keys "2, 5, 8 and 0" passing beneath auxiliary slot 52, and having one end rigidly connected to the key portion 134 and depressor 135, as by a lateral body portion 133. Remote from the key portion 134 and supporting depressor 135, the underside of carrier body 136 is provided with resiliently yieldable depending legs or supports 137. A tab 138 upstands from the body 136 slidably through guide slot 52 and terminates in an oblique or inclined upper end cam surface 139.

The laterally rightward file of keys "3, 6 and 9" are similarly provided with carriers 200, 201 and 202, respectively. The carriers 200, 201 and 202 may each be respectively substantially identical to hereinbefore described carriers 100, 101 and 102. Similarly, the leftward file of keys or buttons "1, 4 and 7" may be respectively provided with carriers 300, 301 and 302, which may be essentially identical to respective carriers 100, 101 and 102. In each of the laterally leftward and rightward files, there is no need for an additional carrier corresponding to hereinbefore described carrier 103.

The carriers 200, 201 and 202 may be respectively provided with upstanding lugs or tabs 208, 218 and 228, while corresponding leftward carriers 300, 301 and 302 are provided with respective upstanding operator lugs or tabs 308, 318 and 328.

In addition to the foregoing, there includes the actuating means 27 which may generally consist of a plate or card 150 of generally rectangular outline configuration and sized for sliding engagement with its opposite longitudinal or side edge margins in respective grooves 25 and 26. The plate or board 150 may have one end beveled or tapered, as at 151 to facilitate entry into the grooves 25 and 26, and the other end of the board or plate may be provided with an upstanding lip or handle 152 for convenient manual gripping.

The card or board may be provided with ten longitudinal rows or files of holes, and ten lateral rows or ranks of holes extending across the board. The holes may each be designated 153, and each longitudinal row or file of holes is located to pass directly over a respective carrier operator tab upon longitudinal sliding movement of the card through receiving grooves 25 and 26. More specifically, the several longitudinal rows or files of holes 153 are respectively designated, see FIG. 12, corresponding to the carrier tab which that file overlies. It will thus be seen that the left most file or row of holes 153 overlies the tab 318 of carrier 301 corresponding to key "4." The next adjacent row or file holes 153 is designated "1" on card 150 of FIG. 12 as it overlies the operator tab 308 corresponding to carrier 300 associated with key "1." The remaining longitudinal rows or files of holes 153 are similarly designated corresponding to the respective associated key.

The several lateral ranks or rows of apertures 153 each correspond to a respective letter or numeral of a telephone number, beginning with the lower most rank and preceding upwardly.

Located in selected holes 153 are a plurality of actuating protrusions or pins 154. One such pin may be seen in FIG. 13 as including a reduced upper end portion 155 having a bevel or chamfer 156 to facilitate entry into a hole 153. The reduced portion may be bifurcated or slotted, as at 157 to afford resilience to the reduced portion for snug frictional engagement in a selected hole 153. The lower remaining portion of each pin 154 may be enlarged, as at 158, defining an upwardly facing annular shoulder 159 for bearing engagement with the underside of board 50 and having its lower end region beveled or chamfered, as at 160 for smooth depressing engagement with a respective tab.

As by the arrangement of pins 154 in board 150, it may be appreciated that the telephone number corresponding to the pin arrangement is the number "171 782 2772." That is, the first numeral of the telephone number is "1" as the pin 154 in the lower most row of holes 153 is located in the file or row corresponding to the numeral "1." The pin 154 in the second lower most lateral rank or row of holes is located in the longitudinal file of holes corresponding to numeral "7," and so forth. Of course, upon movement of the card 150 downwardly within receiving grooves 25 and 26, the lower enlarged portions 158 of actuator pins 154 engage and downwardly shift respective operator tabs to depress the corresponding keys. That is, the pin 154 of the lower most lateral rank or row of holes 153 moves over the carriers 300 and 301 into downwardly depressing engagement with the inclined upper surface of operator tab 308, which depresses the carrier 300 and its corresponding key "1." The successive lateral ranks or rows of holes 153, each with its respective pin 154, operate in like manner to depress a predetermined key to thereby operate the telephone keyboard 11 upon movement of the actuator 27 through its receiving slots 25 and 26.

While the several carriers have been illustrated and described as provided with resilient supports in the nature of flexible depending legs, as at 107, 117, 127, and 137, it is appreciated that other resiliently yieldable support means may be provided. For example, in FIG. 14 there is shown a slightly modified embodiment of carrier designated **101*a*, including an elongate body 116*a* and depending depressor 115*a* at one end. Remote from the depressor 115*a* may be provided a depending resilient coil compression spring 117*a* for yieldable supporting relation and bearing engagement with the upper surface of lower guide member 21**.

From the foregoing, there is seen that the instant invention provides an automatic operator for a telephone keyboard, and for other similar keyboards, which is extremely simple in construction, so as to be relatively inexpensive to manufacture and free from maintenance and malfunction, compact in space, capable of automatic as well as manual operation, and which otherwise fully accomplishes its intended objects.

Although the present invention has been described in some detail by way of illustration and example for purposes of clarity of understanding, it is understood that certain changes and modifications may be made within the spirit of the invention.

What is claimed is:

1. An automatic operator for a keyboard including plural lateral ranks and longitudinal files of keys, said operator comprising a plurality of carriers located over each file for up-and-down movement, a depressor depending from each carrier toward a corresponding key for depressing engagement with the respective key upon downward carrier movement, an upstanding tab on each carrier and offset laterally from each other, lower guide means between said keys and carriers in guiding relation with said depressors, actuating means movable longitudinally of said files over said carriers for actuating engagement with preselected tabs for effecting said depressing engagement, and upper guide means between said carriers and actuating means in guiding relation with said tabs, said carriers each comprising an elongate member extending longitudinally of a respective file in side-by-side relation with the remaining carriers of the associated file, said depressors depending from respective elongate members, said tabs upstanding from respective elongate members, and a manual key on each elongate member upstanding over a respective keyboard key for manual actuation.

2. An automatic operator according to claim 1, said lower guide means comprising a lower plate having a plurality of lateral rows of openings over said ranks of keys and longitudinal rows of openings over said files of keys, the openings of each file being laterally offset from each other, and the carriers of each file being laterally offset from each other with said depressors depending through respective openings.

3. An automatic operator according to claim 1, said upper guide means comprising an upper plate having tab openings in guiding relation with respective tabs.

4. An automatic operator according to claim 3, said carriers each including a manual key upstanding over a respective keyboard key for manual actuation, and said upper plate having key openings presenting respective manual keys to manual operation.

5. An automatic operator according to claim 1, said actuating means comprising a plate-like member, and a plurality of selectively positioned pins depending from said plate-like member for actuating engagement with respective tabs upon movement of said plate-like member.

6. An automatic operator according to claim 1, in combination with resilient means urging said carriers upwardly out of said depressing engagement.

7. An automatic operator according to claim 6, said resilient means comprising leaf springs beneath said carriers.

8. An automatic operator according to claim 1, said tabs being in substantial alignment with each other.

* * * * *